US007385454B2

(12) United States Patent
Kingston et al.

(10) Patent No.: US 7,385,454 B2
(45) Date of Patent: Jun. 10, 2008

(54) FERRITE HOUSING FOR MICROWAVE DEVICES

(75) Inventors: James Paul Kingston, Pepperell, MA (US); Stanley Vincent Paquette, Dracut, MA (US)

(73) Assignee: M/A-COM, Inc., Lowell, MA (US)

( * ) Notice: Subject to any disclaimer, the term of this patent is extended or adjusted under 35 U.S.C. 154(b) by 113 days.

(21) Appl. No.: 11/135,249

(22) Filed: May 23, 2005

(65) Prior Publication Data

US 2006/0261910 A1 Nov. 23, 2006

(51) Int. Cl.
*H01P 1/38* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 4,145,672 A 3/1979 Piotrowski
4,791,389 A 12/1988 Wolfert
5,384,556 A 1/1995 Coles et al.
5,638,033 A 6/1997 Walker et al.
6,011,449 A * 1/2000 Jussaume et al. ..... 333/1.1
6,046,651 A 4/2000 Wendel
6,337,607 B1 * 1/2002 Genfan ..... 333/1.1
6,504,445 B1 1/2003 Kocharyan
6,566,972 B2 5/2003 Paquette et al.
6,965,277 B2 * 11/2005 Kawanami ..... 333/24.2
2003/0107448 A1 6/2003 Kocharyan

FOREIGN PATENT DOCUMENTS

EP 1 289 047 A1 3/2003

* cited by examiner

*Primary Examiner*—Stephen E Jones

(57) ABSTRACT

A ferrite housing is provided that includes a body for receiving at least one ferrite element therein and a plurality of mounting portions extending from and forming part of the body.

18 Claims, 5 Drawing Sheets

FERRITE HOUSING FOR MICROWAVE DEVICES

BACKGROUND OF THE INVENTION

This invention relates generally to microwave devices, and more particularly, to a ferrite housing.

Ferrite circulators are typically configured as multi-port (e.g., three-port) passive RF or microwave devices having magnets and ferrite material that may be used to control the direction of signal flow in, for example, an RF circuit or a microwave circuit. For example, ferrite circulators may be used to control signal flow in wireless base station or power amplifier applications. Ferrite isolators are typically constructed by terminating one port of a ferrite circulator. Terminating one port results in signal or energy flow in only one direction, which may be used, for example, for isolating components in a chain of interconnected components.

In general, a ferrite isolator is a multi-port device, such as a three-port device with one port terminated, and that has a symmetrical Y-junction formed by a magnetically biased ferrite disk or slab. The isolator allows flow of, for example, microwave energy in only one direction (e.g., from one of three ports to another one of the three ports), with one port (e.g., port 3), isolated by a matched termination, thereby providing high attenuation in one direction. In operation, a microwave signal entering one of the ports of the ferrite isolator follows a rotating sense based on the interaction of the electromagnetic wave with the magnetized ferrite. Thus, by symmetrically constructing the ferrite isolator, a defined signal path or direction through the ferrite isolator may be provided. Thus, ferrite isolators may be provided by terminating one of the ports of a ferrite circulator and used to protect against reflections.

Further, known ferrite circulators and isolators include a machined housing, and more particularly, a stamped two-piece housing/base plate assembly, wherein the two pieces (e.g., housing and base plate) are joined (e.g., soldered) in a secondary operation. Other known ferrite circulators and isolators may include a metal injection molded housing having a drop-in body, a high power termination (for isolators) and mounting holes.

These known ferrite circulators and isolators require hard connecting and other secondary operations to assemble or finish the final housing (e.g., connecting a mounting plate or threading or tapping holes for the mounting portions of the housing). This adds time, complexity and cost to the overall manufacture and assembly of these ferrite isolators.

BRIEF DESCRIPTION OF THE INVENTION

According to an exemplary embodiment, a ferrite housing is provided that includes a body for receiving at least one ferrite element therein and a plurality of mounting portions extending from and forming part of the body.

According to another exemplary embodiment, a ferrite device is provided that includes a unitary housing having a body with a plurality of mounting portions extending from the body. The ferrite device also includes at least one ferrite element within the unitary body.

According to yet another exemplary embodiment, a method for providing a ferrite housing includes providing a single form. The method further includes forming from the single form (i) a body for receiving therein at least one ferrite element and (ii) a plurality of mounting portions extending from the body.

DETAILED DESCRIPTION OF THE INVENTION

Figure 1:
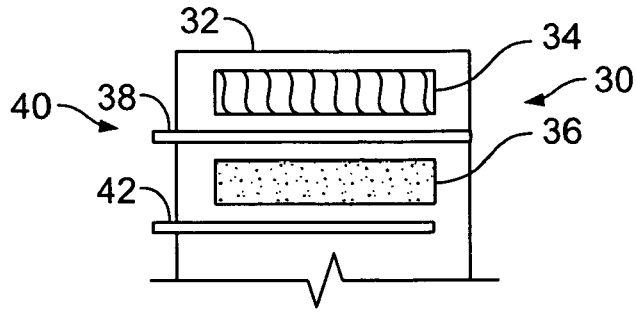
FIG. 1 is a diagram of an exemplary embodiment of a ferrite isolator.

FIG. 1 illustrates an exemplary embodiment of a ferrite device 30, for example, a ferrite circulator or isolator. The ferrite device 30 generally includes a housing 32 defined by a body having one or more magnets 34 and one or more ferrite elements 36 (e.g., ferrite slab or disk) aligned therein. The housing 32 is constructed of a metal, such as, for example, steel or aluminum, and which in one embodiment forms a cylindrical cavity resonator.

The ferrite device 30 also includes a plurality of stripline circuits 38 (only one of the stripline circuits 38 is shown in FIG. 1) defining ports 40 of the ferrite device 30. For example, a Y junction ferrite circulator may be formed by providing three stripline circuits 38 defining three different ports 40 and Y junction ferrite isolator may be formed by terminating one of the ports. For example, one of the three ports 40 may be terminated as is known using a 50 ohm terminator. The ferrite device 30 also may include a ground plane 42 for establishing a ground reference within the ferrite device 30. It should be noted that a dielectric (not shown) between different components, for example, between the ground plane 42 and stripline circuit 38 may be provided within the housing 32 of the ferrite device 30.

Further, although only one magnet 34 and one ferrite element 36 are shown, additional magnets 34 and ferrite elements 36 may be provided in a stacked arrangement within the housing 32. Also, additional stripline circuits 38 defining additional ports 40 may be provided (e.g., four stripline circuits defining a four-port ferrite device 30).

Figure 2:
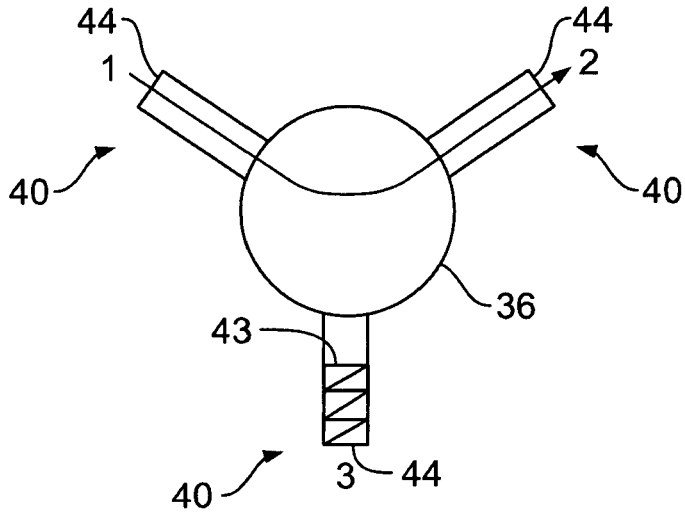
FIG. 2 is a diagram illustrating signal flow through a ferrite isolator.

In operation, and as shown in FIG. 2, power may be applied to any one of a plurality of transmission lines 44 defined by ports 40 that are formed by stripline circuits 38 extending outside the housing 32. When power is applied to one of the plurality of transmission lines 44, a standing wave pattern (not shown) is established. This electromagnetic field pattern is caused by counter-rotating waves created within the housing 32. It should be noted that coupling and isolation within the ferrite device 30 are determined by the relative position of a port 40 and the standing wave pattern.

The presence of an induced axial magnetic field across the ferrite element 36 changes the effective permeability experienced by the rotating waves based upon the sense of rotation. This causes rotation of the standing wave patterns. For example, the ferrite device 30 may be configured such that the power transfer and isolation properties are provided such that the standing wave pattern is rotated thirty degrees.

Figure 3:
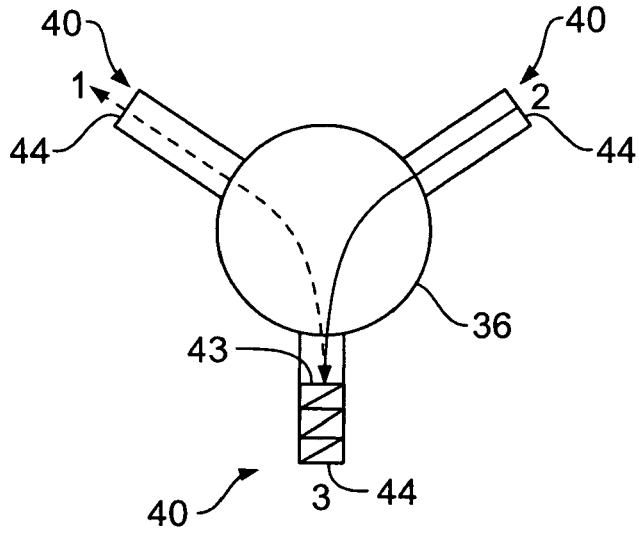
FIG. 3 is a diagram illustrating signal flow isolation in a ferrite isolator.

For a ferrite isolator, and as shown in FIGS. 2 and 3, one of the ports 40 (e.g., port 3) is internally terminated using a terminator 43 (e.g., 50 ohm termination) to provide a two-port isolator. In this embodiment, with a clockwise direction of circulation, forward power flow is provided from port 1 to port 2 when an input signal is applied to port 1. Reverse power flow is provided from port 2 to port 3 when an input signal is applied to port 2. However, because port 3 is terminated, most of the signal that flows from port 2 to port 3 is absorbed by the terminator 43 as is known. It should be noted that the isolation of flow from port 2 to port 1 is determined by the terminator 43 and the Voltage Standing Wave Ratio (VSWR) of port 3. It also should be noted that some signal flow may be reflected from port 3 and circulated back to port 1. It should be noted that for a ferrite circulator, the termination is provided externally.

Figure 4:
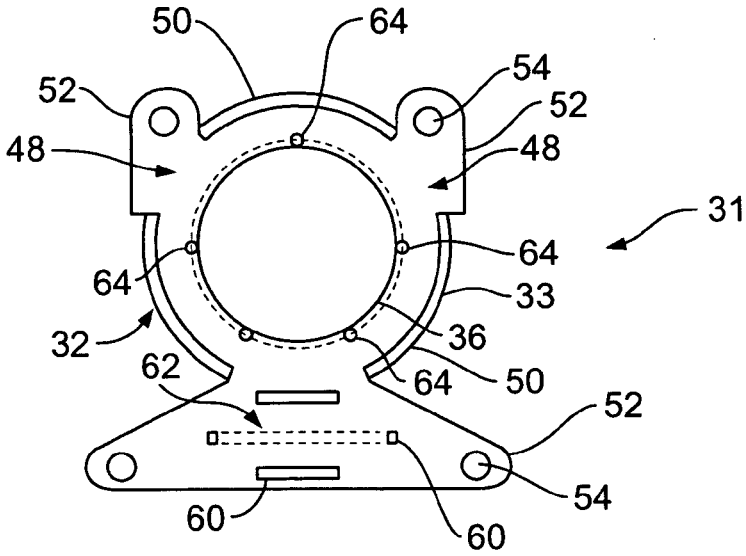
FIG. 4 is a top plan view of a ferrite isolator housing constructed in accordance with an exemplary embodiment of the invention.
Figure 5:
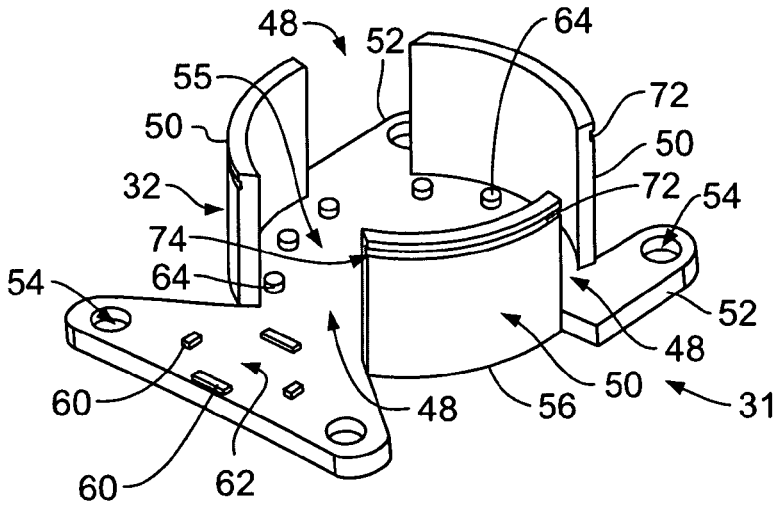
FIG. 5 is a top perspective view of a ferrite isolator housing constructed in accordance with an exemplary embodiment of the invention.

Various embodiments of the invention provide a one piece housing 32, having a unitary construction, which in an exemplary embodiment, is a one piece drop-in ferrite housing wherein no secondary operations are needed to manufacture or construct the housing 32. Specifically, for a ferrite isolator 31 as shown in FIGS. 4 and 5, the housing 32 includes a body 33 (e.g., drop-in isolator body) having a plurality of openings 48, for example slots, formed in between the sides or side walls 50 of the body 33. The openings allow extension therefrom of the stripline circuits 38 (shown in FIGS. 1 and 7) to define ports 40 (shown in FIGS. 1-3) of the ferrite isolator 31. Additionally, the housing 32 includes a plurality of mounting portions 52 formed as part of the housing 32 for use in mounting the housing 32, for example, within a microwave device. More particularly, the housing 32 in an exemplary embodiment is a single piece design with the mounting portions 52 and body 33 formed from the single piece. Each of the mounting portions 52 generally corresponds to one of the openings 48 and includes one or more mounting holes 54 that may be used to mount the housing 32 using, for example, screws or bolts. The mounting holes 54 may be smooth or threaded, for example, based on the application for the ferrite isolator 31. Each of the mounting portions 52 extends generally laterally from a bottom or lower portion 56 of the housing 32 and generally perpendicular to the sides or side walls 50. It should be noted that each of the mounting portions 52 may be sized and shaped as desired or needed. In an exemplary embodiment, the mounting portions 52 are sized and shaped to correspond to a standard footprint for mounting ferrite isolators and as is known, for example, 1 inch by 1.25 inches and 1 inch by 1 inch.

In an exemplary embodiment, one of the mounting portions 52 includes a plurality of alignment members 60 integrally formed as part of the housing 32 and extending generally perpendicularly to a plane of the bottom or lower portion 56 of the housing 32. The alignment members may be, for example, protrusions that define a terminator mounting region 62 for receiving, and mounting (e.g., by epoxy) and maintaining therein, a terminator 43 (shown in FIGS. 2 and 3), for example, a chip terminator 71 (shown in FIG. 7). In an exemplary embodiment, this mounting portion 52 having the terminator mounting region 62 is generally triangular in shape. The terminator 43 terminates a port 40 (shown in FIGS. 2 and 3) of the ferrite isolator 31. The terminator mounting region 62 is provided as a generally planar area for supporting the terminator 43 substantially horizontally therein.

Further, a plurality of alignment members 64 for aligning the ferrite element 36 within the housing 32 also may be provided. The plurality of alignment members 64 are integrally formed as part of the housing 32 to align a ferrite element 36 therein. The plurality of alignment members 64 extend generally perpendicularly to a plane of the bottom or lower portion 56 of the housing 32, for example, as protrusions, to define an alignment region 55 for maintaining therein the ferrite element 36. An example of the alignment members 64 is described in co-pending and commonly owned U.S. patent application entitled "Ferrite Circulator Having Alignment Members" having Ser. No. 10/894,812.

It should be noted that the number and configuration of the alignment members 60 and 64 may be modified as desired or needed. For example, although the alignment members 60 and 64 are shown as having a particular shape, the shape of the alignment members 60 and 64 may be provided having, for example, a square, rectangular, octagonal or other geometric shaped cross-section for maintaining therein different terminators 43 or ferrite elements 36, respectively. Further, the height of the alignment members 60 and 64 may be modified to accommodate (e.g., receive in the alignment region 55) and maintain therein different height terminators 43 or more than one ferrite element 36 provided in a stacked arrangement, respectively.

Further, the number and positioning of the alignment members 60 and 64 may be modified to accommodate different sizes and shapes of terminators 43 or ferrite elements 36, respectively. For example, the alignment members 60 and 64 may be arranged to define a square, rectangular, octagonal or other geometrically shaped regions for receiving and maintaining therein or therebetween a correspondingly shaped terminator 43 or ferrite element 36.

The alignment members 60 and 64 are integrally formed as part of the housing 32 in the various embodiments. For example, the alignment members 60 and 64 may be formed into the housing 32 using a machining, stamping, casting and/or molding process, which may be a single or multiple step process. For example, in one exemplary embodiment, a two step process is performed to form the alignment members 60 and 64 and corresponding regions therebetween. Specifically, in a first step the alignment members 60 or 64 are formed (e.g., by stamping or pulling up posts from the bottom or lower portion 56) and in a second step, the planar regions therebetween are formed. In operation, this two step process may include, for example, a first machining strike to form the alignment members 60 or 64 (e.g., posts) and a second machining strike to flatten the planar regions to provide a planar surface between the alignment members 60 or 64. During the manufacturing process, the alignment members 60 and 64 may be formed at any position along the bottom or lower portion 56 of the housing 32.

It further should be noted that the integral forming of the alignment members 60 and 64 as part of the housing 32 to form a single unitary piece may be provided by any suitable process, including, but not limited to, shearing, extruding, punching, etc. In a molding or casting process, the alignment members 60 and 64 may be formed in the housing 32 at the time of molding or casting, or as part of a secondary step.

Figure 6:
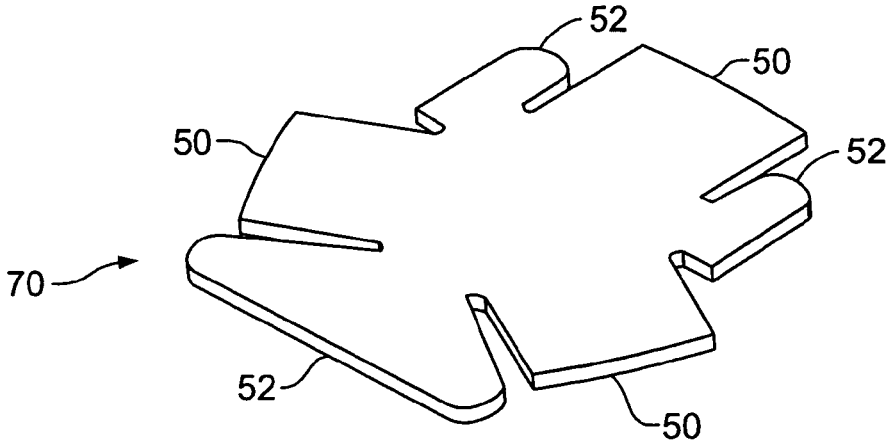
FIG. 6 is a top perspective view of a form in accordance with an exemplary embodiment of the invention for use in constructing a ferrite isolator housing.

The housing 32 is formed from a single generally planar form 70 (e.g., flat metal form) as shown in FIG. 6. The planar form 70 may include different geometric shapes or patterns as desired or needed, for example, circles, squares, rectangles, hexagons, etc. The form 70 is provided in a shape to include portions that define the sides or side walls 50 and the mounting portions 52. Thus, the housing 32 with mounting portions 52 and openings 48 is formed from the single form 70. For example, the form 70 may be constructed using a machining process, such as an electrical discharge machining process with the mounting holes 54 formed therein using a stamping process. The alignment members 60 and 64 may be formed by a stamping or other suitable process as described above. The sides or side walls 50 may be formed by a bending tool.

The process of forming the housing 32 from the form 70 may be accomplished in a multiple step process with the order of the steps changed as desired or needed. In an exemplary embodiment, the form 70 is stamped or machined from a larger piece of metal, the mounting holes 54 then cut therein and the alignment members 60 or 64 and alignment or mounting areas formed thereafter. Following this process, the sides or side walls 50 are formed by bending the form 70. However, the processes used to form the housing 32 may be modified as desired or needed and any suitable forming or machining process may be used. Further, because the ordering of the steps may be modified, the bending may be performed, for example, before the stamping. Additionally, the form 70 may be configured in different shapes and sizes depending on the particular application or use. The form 70 also may be modified such that a dual junction ferrite isolator (not shown) having two housings with mounting portions may be provided instead of the single junction ferrite isolator 31 (shown in FIGS. 4 and 5) having one housing 32.

Further, the form 70 may be machined to include additional portions. For example, a groove 72 may be formed along a top outer portion 74 of the sides or side walls 50 for receiving therein a complementary member of a cover for enclosing ferrite elements 36 within the housing 32.

Figure 7:
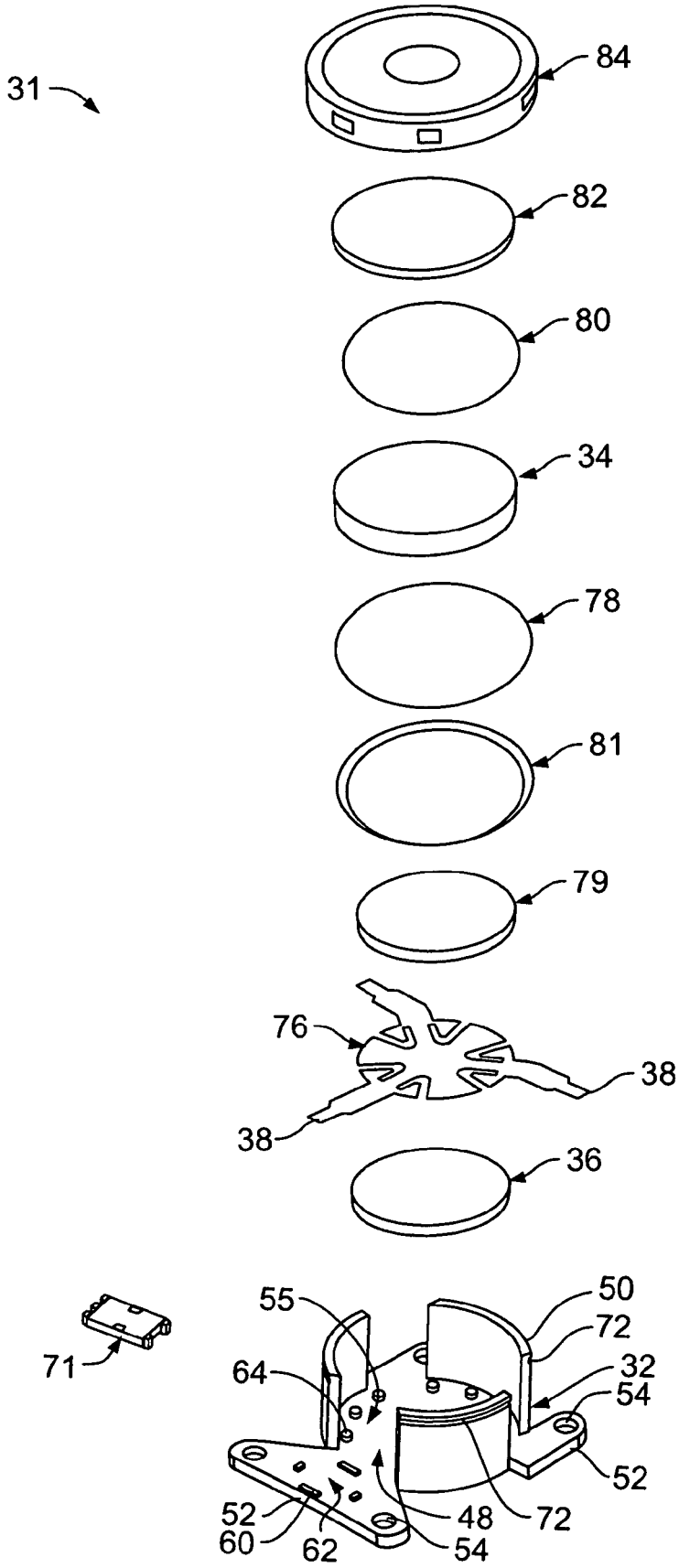
FIG. 7 is an exploded perspective view of a ferrite isolator in accordance with an exemplary embodiment of the invention.

Thus, as shown in FIG. 7, a ferrite isolator 31 having a housing 32 formed from a single form 70 is provided. For example, a housing 32 having mounting portions 52 and alignment members formed thereon may be provided.

As shown, one or more ferrite elements 36 (e.g., ferrite disks) are inserted within an alignment region 55 defined by the plurality of alignment members 64. A circuit element 76, comprising a plurality of stripline circuits 38 is provided on top of the ferrite element 36. One of the stripline circuits 38 extending through an opening 48 and defining a port 40 may be terminated by (e.g., connected to) a terminator 71 mounted within the terminator mounting region 62. A dielectric 79 is then provided between the circuit element 76 and a ground plane 81. A spacer 78 may be provided between the ground plane 81 and the magnet 34 (when only one ferrite element 36 is included). A pole piece 80 is provided on top of the magnet 34 and a cover return 82 is provided on top of the pole piece 80. A cover 84 is then provided on top of the cover return 82 and may be secured to the housing 32 using the groove 72.

It should be noted that the spacer 78 is provided between the circuit element 76 and the magnet 34 to minimize the "lossyness" of the circuit element 76 that would occur if the magnet 34 contacts the circuit element 76. Further the pole piece 80 and return cover 82 are provided and configured to focus the magnetic fields within the housing 32 as is known and to direct flow of energy therethrough. Also, in various embodiments, the cover 84 is spring loaded to apply a downward force on the components within the housing 32 to maintain the position and alignment of the components therein. As described herein, the cover 84 and housing 32 may have complimenting portions to secure the cover 84 to the housing 32 (e.g., snap fit).

Thus, a ferrite isolator 31 having a unitary construction of a housing 32 with mounting portions 52 formed from a single form 70 may be provided. The plurality of mounting portions 52 essentially extend from and form part of the body 33. The housing 32 also may include a plurality of alignment members. The housing 32 that includes a drop-in isolator body, mounting portions, termination aligners, ferrite aligners and cover retainer groove can all be formed progressively during, for example, a stamping process, in one piece with one progressive stamping die.

Figure 8:
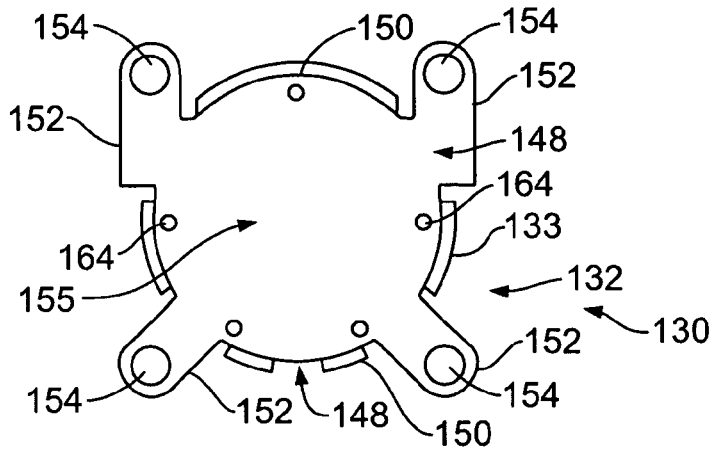
FIG. 8 is a top plan view of a ferrite circulator housing constructed in accordance with an exemplary embodiment of the invention.
Figure 9:
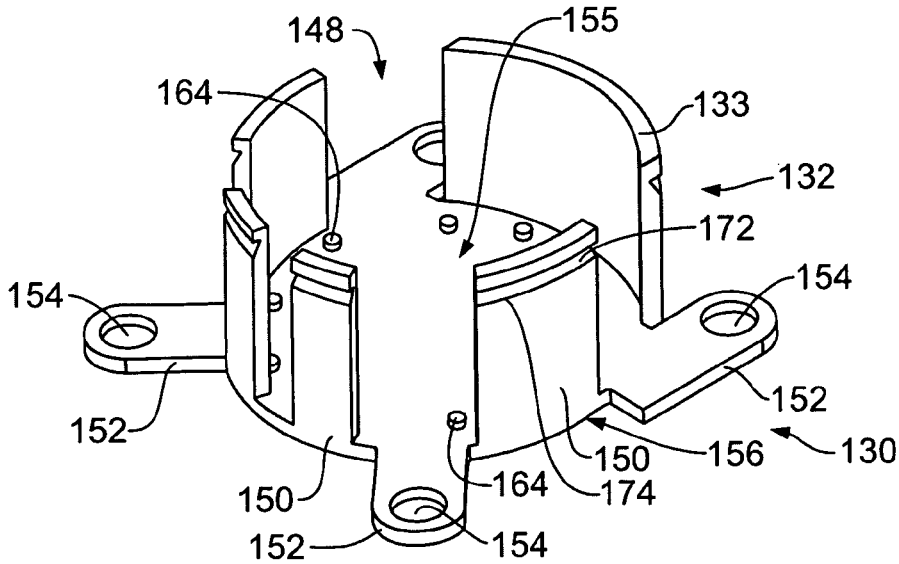
FIG. 9 is a top perspective view of a ferrite circulator housing constructed in accordance with an exemplary embodiment of the invention.

It should be noted that the various embodiments are not limited to a ferrite isolator 31 having a unitary construction, but may implemented in connection with any type of ferrite device. For example, a ferrite circulator 130 having a one piece housing 132, with a unitary construction, which in an exemplary embodiment, is a one piece drop-in ferrite housing wherein no secondary operations are needed to manufacture or construct the housing 132 may be provided. Specifically, for the ferrite circulator 130 as shown in FIGS. 8 and 9, the housing 132 includes a body 133 (e.g., drop-in circulator body) having a plurality of openings 148, for example slots, formed in between the sides or side walls 150 of the body 133. The openings allow extension therefrom of the stripline circuits 38 (shown in FIGS. 1 and 7) to define ports 40 (shown in FIGS. 1-3) of the ferrite circulator 130. Additionally, the housing 132 includes a plurality of mounting portions 152 formed as part of the housing 132 for use in mounting the housing 132, for example, within a microwave device.

More particularly, the housing 132 in an exemplary embodiment is a single piece design with the mounting portions 152 and body 133 formed from the single piece. Each of the mounting portions 152 generally corresponds to one of the openings 148 and includes one or more mounting holes 154 that may be used to mount the housing 132 using, for example, screws or bolts. The mounting holes 154 may be smooth or threaded, for example, based on the application for the ferrite circulator 130. Each of the mounting portions 152 extends generally laterally from a bottom or lower portion 156 of the housing 32 and generally perpendicular to the sides or side walls 150. It should be noted that each of the mounting portions 152 may be sized and shaped as desired or needed. In an exemplary embodiment, the mounting portions 152 are sized and shaped to correspond to a standard footprint for mounting ferrite circulators and as is known, for example, 1 inch by 1.25 inches and 1 inch by 1 inch.

Further, a plurality of alignment members 164 for aligning the ferrite element 136 (not shown) within the housing 132 also may be provided. The plurality of alignment members 164 are integrally formed as part of the housing 132 to align a ferrite element 136 therein. The plurality of alignment members 164 extend generally perpendicularly to a plane of the bottom or lower portion 156 of the housing 132, for example, as protrusions, to define an alignment region 155 for maintaining therein the ferrite element 136. An example of the alignment members 164 is described in co-pending and commonly owned U.S. patent application entitled "Ferrite Circulator Having Alignment Members" having Ser. No. 10/894,812.

It should be noted that the number and configuration of the alignment members 164 may be modified as desired or needed. For example, although the alignment members 164 are shown as having a particular shape, the shape of the alignment members 164 may be provided having, for example, a square, rectangular, octagonal or other geometric shaped cross-section for maintaining therein different ferrite elements 136. Further, the height of the alignment members 164 may be modified to accommodate (e.g., receive in the alignment region 155) and maintain therein more than one ferrite element 136 provided in a stacked arrangement.

Further, the number and positioning of the alignment members 164 may be modified to accommodate different sizes and shapes of terminators ferrite elements 136. For example, the alignment members 164 may be arranged to define a square, rectangular, octagonal or other geometrically shaped regions for receiving and maintaining therein or therebetween a correspondingly shaped ferrite element 136.

The alignment members 164 are integrally formed as part of the housing 132 in the various embodiments. For example, the alignment members 164 may be formed into the housing 132 using a machining, stamping, casting and/or molding process, which may be a single or multiple step process. For example, in one exemplary embodiment, a two step process is performed to form the alignment members 164 and corresponding regions therebetween. Specifically, in a first step the alignment members 164 are formed (e.g., by stamping or pulling up posts from the bottom or lower portion 156) and in a second step, the planar regions therebetween are formed. In operation, this two step process may include, for example, a first machining strike to form the alignment members 164 (e.g., posts) and a second machining strike to flatten the planar regions to provide a planar surface between the alignment members 164. During the manufacturing process, the alignment members 164 may be formed at any position along the bottom or lower portion 156 of the housing 132.

It further should be noted that the integral forming of the alignment members 164 as part of the housing 132 to form a single unitary piece may be provided by any suitable process, including, but not limited to, shearing, extruding, punching, etc. In a molding or casting process, the alignment members 164 may be formed in the housing 132 at the time of molding or casting, or as part of a secondary step.

Figure 10:
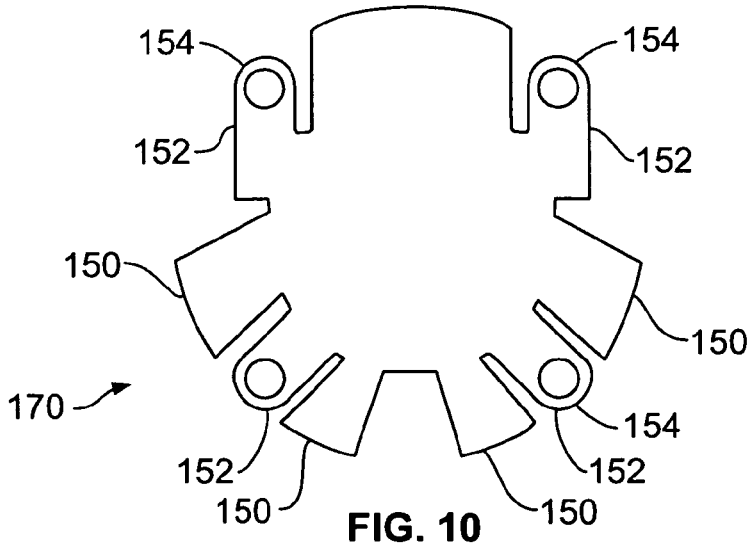
FIG. 10 is a top perspective view of a form in accordance with an exemplary embodiment of the invention for use in constructing a ferrite circulator housing.

The housing 132 is formed from a single generally planar form 170 (e.g., flat metal form) as shown in FIG. 10. The planar form 170 may include different geometric shapes or patterns as desired or needed, for example, circles, squares, rectangles, hexagons, etc. The form 170 is provided in a shape to include portions that define the sides or side walls 150 and the mounting portions 152. Thus, the housing 132 with mounting portions 152 and openings 148 is formed from the single form 170. For example, the form 170 may be constructed using a machining process, such as an electrical discharge machining process with the mounting holes 154 formed therein using a stamping process. The alignment members 164 may be formed by a stamping or other suitable process as described above. The sides or side walls 150 may be formed by a bending tool.

The process of forming the housing 132 from the form 170 may be accomplished in a multiple step process with the order of the steps changed as desired or needed. In an exemplary embodiment, the form 170 is stamped or machined from a larger piece of metal, the mounting holes 154 then cut therein and the alignment members 164 and alignment or mounting areas formed thereafter. Following this process, the sides or side walls 150 are formed by bending the form 170. However, the processes used to form the housing 132 may be modified as desired or needed and any suitable forming or machining process may be used. Further, because the ordering of the steps may be modified, the bending may be performed, for example, before the stamping. Additionally, the form 170 may be configured in different shapes and sizes depending on the particular application or use. The form 170 also may be modified such that a dual junction ferrite circulator (not shown) having two housings with mounting portions may be provided instead of the single junction ferrite circulator 130 (shown in FIGS. 8 and 9) having one housing 32.

Further, the form 170 may be machined to include additional portions. For example, a groove 172 may be formed along a top outer portion 174 of the sides or side walls 150 for receiving therein a complementary member of a cover for enclosing ferrite elements 136 within the housing 132.

Figure 11:
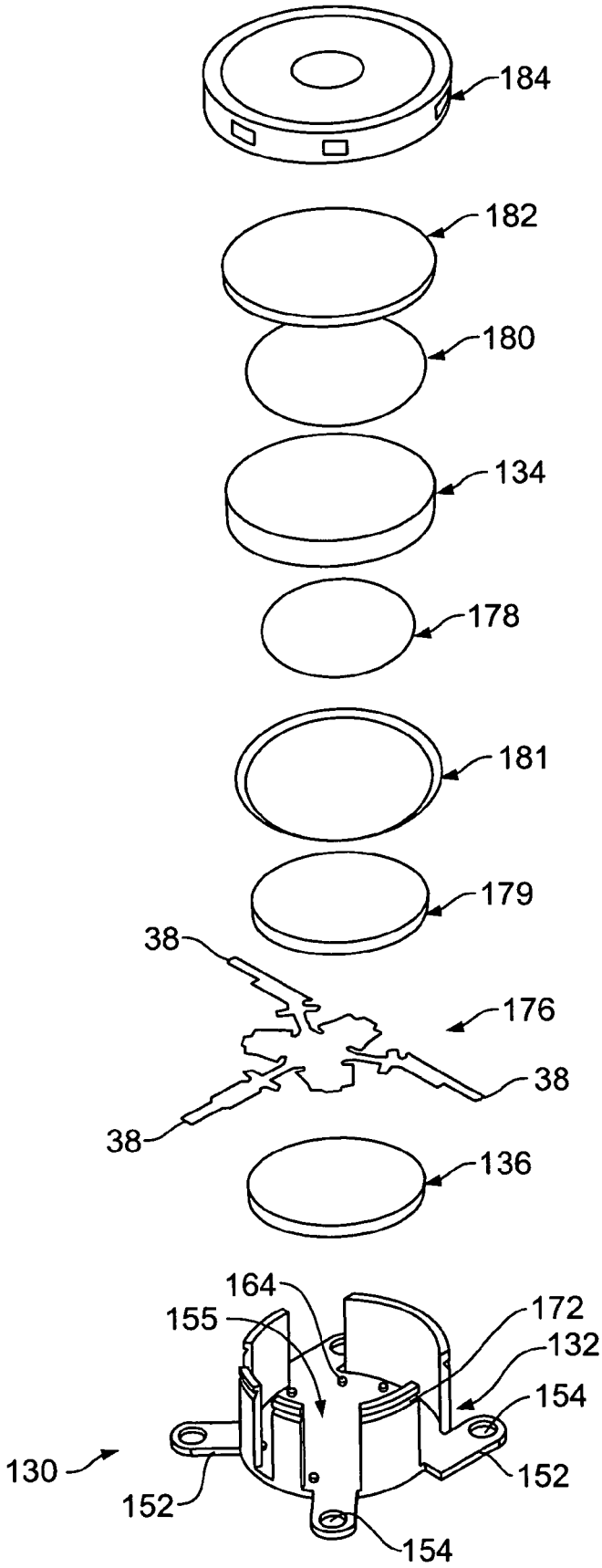
FIG. 11 is an exploded perspective view of a ferrite circulator in accordance with an exemplary embodiment of the invention.

Thus, as shown in FIG. 11, a ferrite circulator 130 having a housing 132 formed from a single form 170 is provided. For example, a housing 132 having mounting portions 152 and alignment members formed thereon may be provided.

As shown, one or more ferrite elements 136 (e.g., ferrite disks) are inserted within an alignment region 155 defined by the plurality of alignment members 164. A circuit element 176, comprising a plurality of stripline circuits 38 is provided on top of the ferrite element 136. A dielectric 179 is then provided between the circuit element 176 and a ground plane 181. A spacer 178 may be provided between the ground plane 181 and the magnet 134 (when only one ferrite element 136 is included). A pole piece 180 is provided on top of the magnet 134 and a cover return 182 is provided on top of the pole piece 180. A cover 184 is then provided on top of the cover return 182 and may be secured to the housing 132 using the groove 172.

It should be noted that the spacer 178 is provided between the circuit element 176 and the magnet 134 to minimize the "lossyness" of the circuit element 176 that would occur if the magnet 134 contacts the circuit element 176. Further the pole piece 180 and return cover 182 are provided and configured to focus the magnetic fields within the housing 132 as is known and to direct flow of energy therethrough. Also, in various embodiments, the cover 184 is spring loaded to apply a downward force on the components within the housing 132 to maintain the position and alignment of the components therein. As described herein, the cover 184 and housing 132 may have complimenting portions to secure the cover 184 to the housing 132 (e.g., snap fit).

Thus, a ferrite circulator 130 having a unitary construction of a housing 132 with mounting portions 152 formed from a single form 170 may be provided. The plurality of mounting portions 152 essentially extend from and form part of the body 133. The housing 132 also may include a plurality of alignment members. The housing 132 that includes a drop-in circulator body, mounting portions, ferrite aligners and cover retainer groove can all be formed progressively during, for example, a stamping process, in one piece with one progressive stamping die.

While the invention has been described in terms of various specific embodiments, those skilled in the art will recognize that the invention can be practiced with modification within the spirit and scope of the claims.

What is claimed is:

1. A ferrite housing comprising:

a body for receiving at least one ferrite element therein, the body including a plurality of openings defining ports;

at least one stripline circuit within the body and wherein each of the plurality of openings is configured to allow extension therefrom of the at least one stripline circuit; and a plurality of mounting portions extending laterally outwardly from the body and forming part of the body and having mounting holes configured to receive therethrough attachment members to mount the body to another structure, wherein the at least one stripline circuit extends from the body through at least one of the plurality of openings in a direction different from and not aligned with a direction in which a corresponding mounting portion extends.

2. A ferrite housing in accordance with claim 1 wherein each of the plurality of mounting portions comprises at least one mounting hole for mounting the body to an object.

3. A ferrite housing in accordance with claim 1 wherein the plurality of mounting portions extend generally laterally from a lower portion of the body.

4. A ferrite housing in accordance with claim 1 wherein each of the plurality of mounting portions corresponds to different one of a plurality of openings in the body.

5. A ferrite housing in accordance with claim 1 wherein the body comprises a groove formed along a top outer portion of the body configured to maintain connection of a cover to the body.

6. A ferrite housing in accordance with claim 1 wherein the plurality of mounting portions and the body have a unitary construction.

7. A ferrite housing in accordance with claim 1 wherein the mounting portions are configured to have shape corresponding to a standard ferrite isolator footprint.

8. A ferrite housing in accordance with claim 1 wherein the body is configured as one of a ferrite circulator body and a ferrite isolator body.

9. A ferrite housing in accordance with claim 1 wherein the body and plurality of mounting portions are constructed from a single metal form.

10. A ferrite housing in accordance with claim 9 wherein the body and plurality of mounting portions are configured to be formed from the single metal form without secondary operation.

11. ferrite housing in accordance with claim 9 wherein the body and plurality of mounting portions are formed from the single metal form using a multiple step process.

12. A ferrite housing in accordance with claim 1 wherein one of the plurality of mounting portions is configured to receive a terminator thereon.

13. A ferrite housing in accordance with claim 12 wherein the mounting portion configured to receive the terminator thereon is configured in a generally triangular shape.

14. A ferrite housing in accordance with claim 12 further comprising a plurality of alignment members extending from one of the mounting portions and defining a terminator mounting region for maintaining the position of a terminator received therein.

15. A ferrite housing in accordance with claim 14 wherein the plurality of alignment members are integrally formed as part of the mounting portion.

16. A ferrite device comprising:

a unitary housing formed from a single generally planar form and having a body with a plurality of mounting portions extending laterally outwardly from the body, the mounting portions having at least four mounting holes each threaded to receive therein a screw; and at least one ferrite element within the unitary body.

17. A ferrite device in accordance with claim 16 further comprising a plurality of alignment members extending from one of the mounting portions for receiving a terminator therein.

18. A ferrite device in accordance with claim 16 wherein the housing is formed from a single metal form.

* * * * *